US006837743B2

(12) United States Patent
Ko

(10) Patent No.: US 6,837,743 B2
(45) Date of Patent: Jan. 4, 2005

(54) CABLE END CONNECTOR HAVING GOOD INSULATION FUNCTION

(75) Inventor: David Tso-Chin Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 32 days.

(21) Appl. No.: 10/373,916

(22) Filed: Feb. 24, 2003

(65) Prior Publication Data

US 2003/0190824 A1 Oct. 9, 2003

Related U.S. Application Data

(63) Continuation-in-part of application No. 10/118,223, filed on Apr. 5, 2002.

(51) Int. Cl.[7] ..... H01R 9/05
(52) U.S. Cl. ..... 439/582; 439/585
(58) Field of Search ..... 439/63, 578–585, 439/607, 610

(56) References Cited

U.S. PATENT DOCUMENTS

| | | | | |
|---|---|---|---|---|
| 5,263,877 A | | 11/1993 | Mitani | |
| 5,322,453 A | | 6/1994 | Resnick et al. | |
| 5,569,049 A | * | 10/1996 | Tatebe et al. | 439/394 |
| 5,772,470 A | * | 6/1998 | Togashi | 439/582 |
| 5,879,190 A | * | 3/1999 | Maruyama et al. | 439/582 |
| 6,305,980 B2 | * | 10/2001 | Ko | 439/582 |
| 6,508,668 B1 | * | 1/2003 | Yamane | 439/582 |

FOREIGN PATENT DOCUMENTS

WO WO94/24722 10/1994

* cited by examiner

*Primary Examiner*—Hien Vu
(74) *Attorney, Agent, or Firm*—Wei Te Chung

(57) ABSTRACT

A cable end connector includes an insulative housing (10), a terminal (40) received in the housing, a metal shell (50) enclosing the housing, and an independent thin layer insulator (1). The independent thin layer insulator is located between the housing and the metal shell for insulating the terminal from the metal shell, whereby the cable end connector achieves a good insulation function between the terminal and the metal shell.

6 Claims, 6 Drawing Sheets

CABLE END CONNECTOR HAVING GOOD INSULATION FUNCTION

CROSS-REFERENCE TO RELATED APPLICATION

This application is a continuation-in-part of a co-pending U.S. patent application entitled "LOW PROFILE CABLE END CONNECTOR", with application Ser. No. 10/118,223, filed on Apr. 5, 2002, invented by the same inventor, and assigned to the same assignee of the present invention.

BACKGROUND OF THE INVENTION

1. Field of the Invention

The present invention relates to a connector, and more particularly to a low profile cable end connector for high frequency application.

2. Description of the Prior Art

Cable end connectors are often used for transmitting Radio-frequency (RF) signals. The cable end connector normally has a terminal received in a housing thereof to mate with a complementary connector, such as a header. Such a conventional cable end connector is, for example, disclosed in U.S. Pat. No. 5,322,453. The cable end connector includes a dielectric member holding a central terminal within an outer conductive shell. The dielectric member is substantially cylindrical and defines a coaxial passageway therein for receiving the terminal. A pair of small tabs projects from the terminal and abuts against an inner surface of the dielectric member, thereby retaining the terminal in the dielectric member. The outer conductive shell is bent at right angle to cover an opening of the passageway. However, because current cable end connector is very small, the tabs of the terminal of the small cable end connector are too tiny to retain the terminal in the dielectric member. By a relatively large mating force of the header, the terminal tends to be pushed out of the dielectric member to touch the conductive shell, resulting in an unreliable insulation function between the terminal and the conductive shell.

In order to solve the above-mentioned problem, U.S. Pat. No. 6,508,668 discloses a conventional cable end connector. The cable end connector also includes a dielectric member holding a central terminal within an outer conductive shell. As disclosed in this patent, in assembly, an upper cover section of the dielectric member and a holder portion of the outer shell are bent substantially at a right angle to hold the terminal and an inner conductor of the coaxial cable within the dielectric member and to crimp the coaxial cable braiding to the outer conductive shell.

As for its design, the dielectric member must be formed of a flexible material to possess a certain degree of resiliency, thereby ensuring it capable of being bent to the right angle without breakage. On the contrary, however, the flexible dielectric member may be not strong enough to securely hold the terminal therein. The terminal, therefore, tends to move with respect to the flexible dielectric member when the cable end connector mates/unmates with/from the header. The movement inevitably bends the terminal of the cable end connector or a contact of the header.

Hence, an improved cable end connector is desired to overcome the above-mentioned problems of existing cable end connector.

BRIEF SUMMARY OF THE INVENTION

A main object of the present invention is to provide a cable end connector which is capable of reliably insulating a terminal from a metal shell thereof.

Another object is to provide a cable end connector having a terminal reliably received in the housing thereof.

A cable end connector according to the present invention comprises an insulative housing, a terminal received in the housing, a metal shell enclosing the housing, a circular thin layer insulator and a retainer attached to the shell for holding a coaxial cable therein. The insulative housing defines a passageway therethrough. The passageway has an end exposed to the metal shell. The terminal is received in the passageway of the housing for electrically engaging with a complementary connector. The metal shell comprises a planar portion covering the housing. The planar portion of metal shell faces the end of the passageway. The circular thin layer insulator is located between the end of the passageway of the housing and the planar portion of the metal shell, thereby insulating the terminal from the metal shell. The retainer is attached to the metal shell for retaining the metal shell to the housing.

By such a design, the terminal is insulated from the metal shell by the covering of the circular thin layer insulator. When the terminal suffers from a large mating force of the header, the circular thin layer insulator prevents the terminal from touching the metal shell, thereby achieving a good insulation function. In addition, the cable end connector is capable of securely retaining the terminal therein.

Other objects, advantages and novel features of the invention will become more apparent from the following detailed description when taken in conjunction with the accompanying drawings.

DETAILED DESCRIPTION OF THE INVENTION

Figure 1:
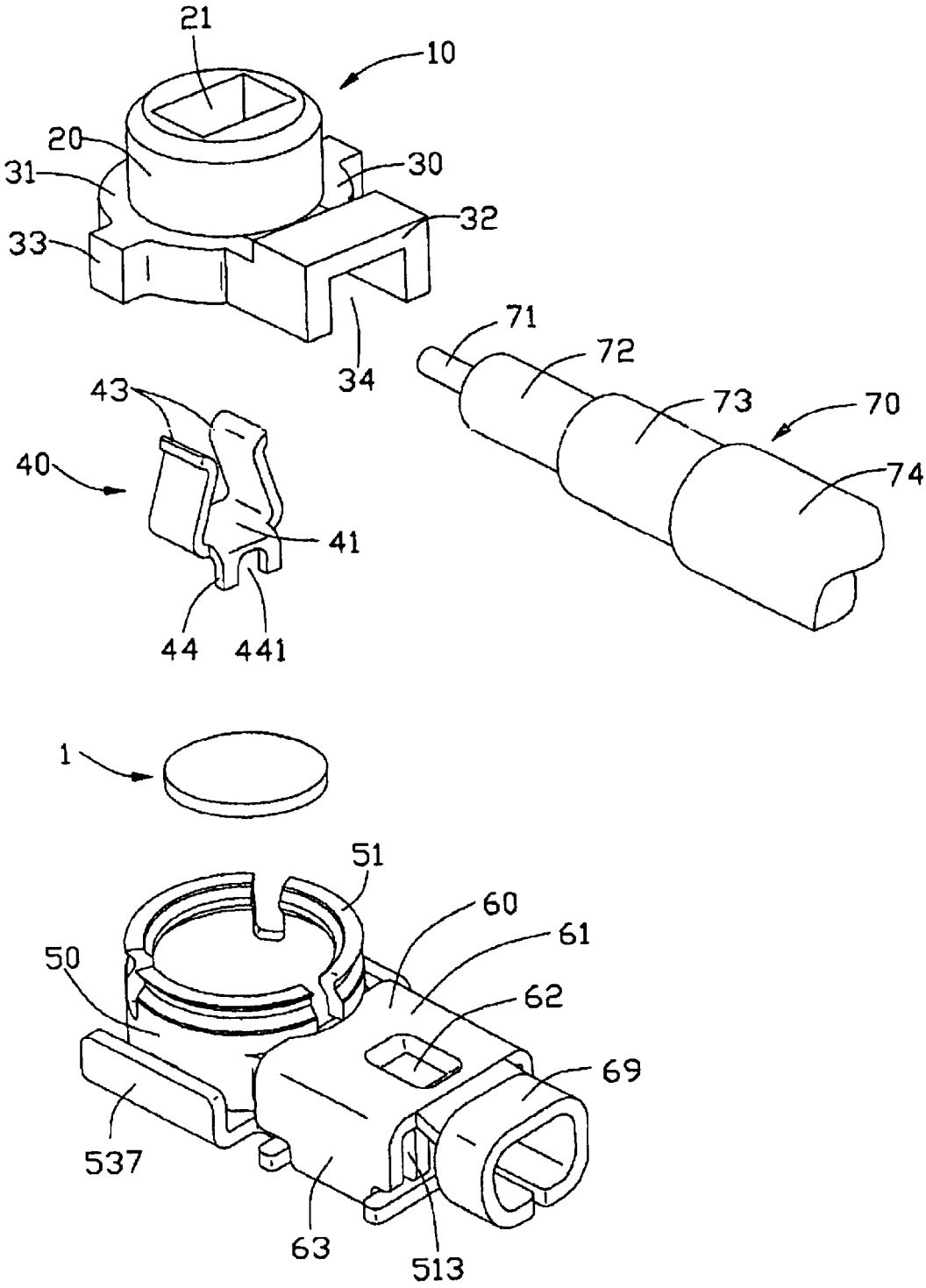
FIG. 1 is an exploded view of a cable end connector according to the present invention and a coaxial cable.
Figure 2:
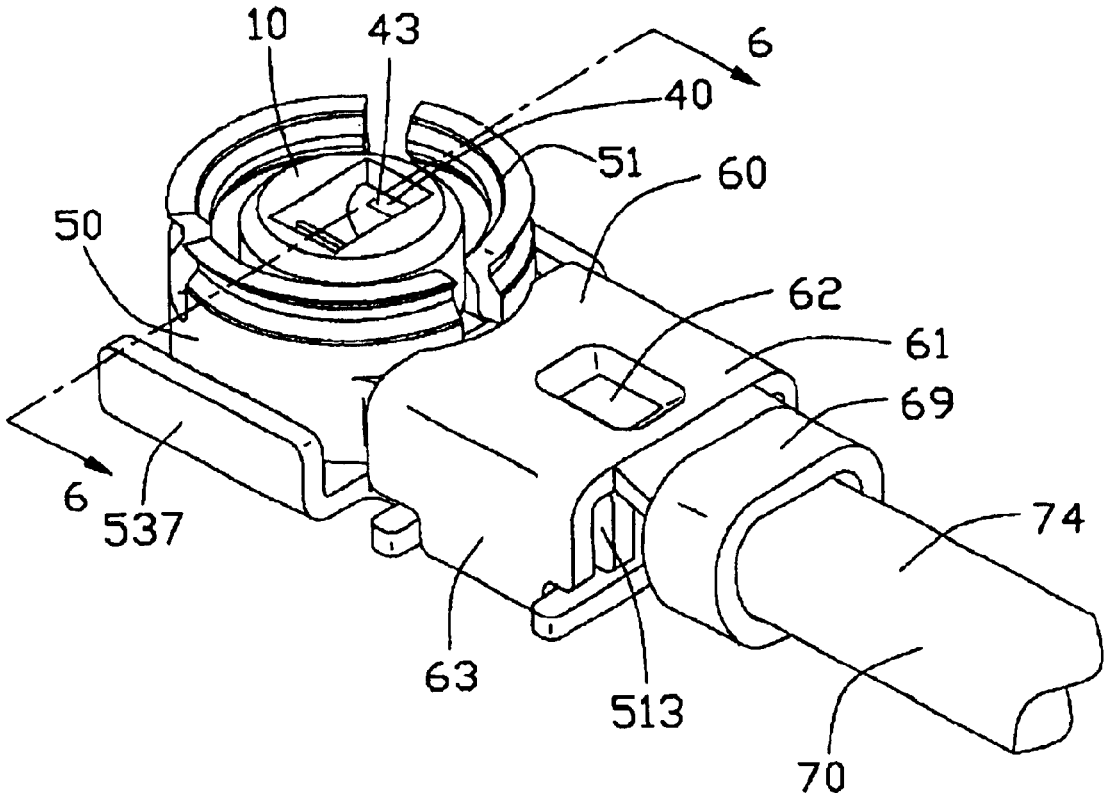
FIG. 2 is an assembled view of FIG. 1.
Figure 3:
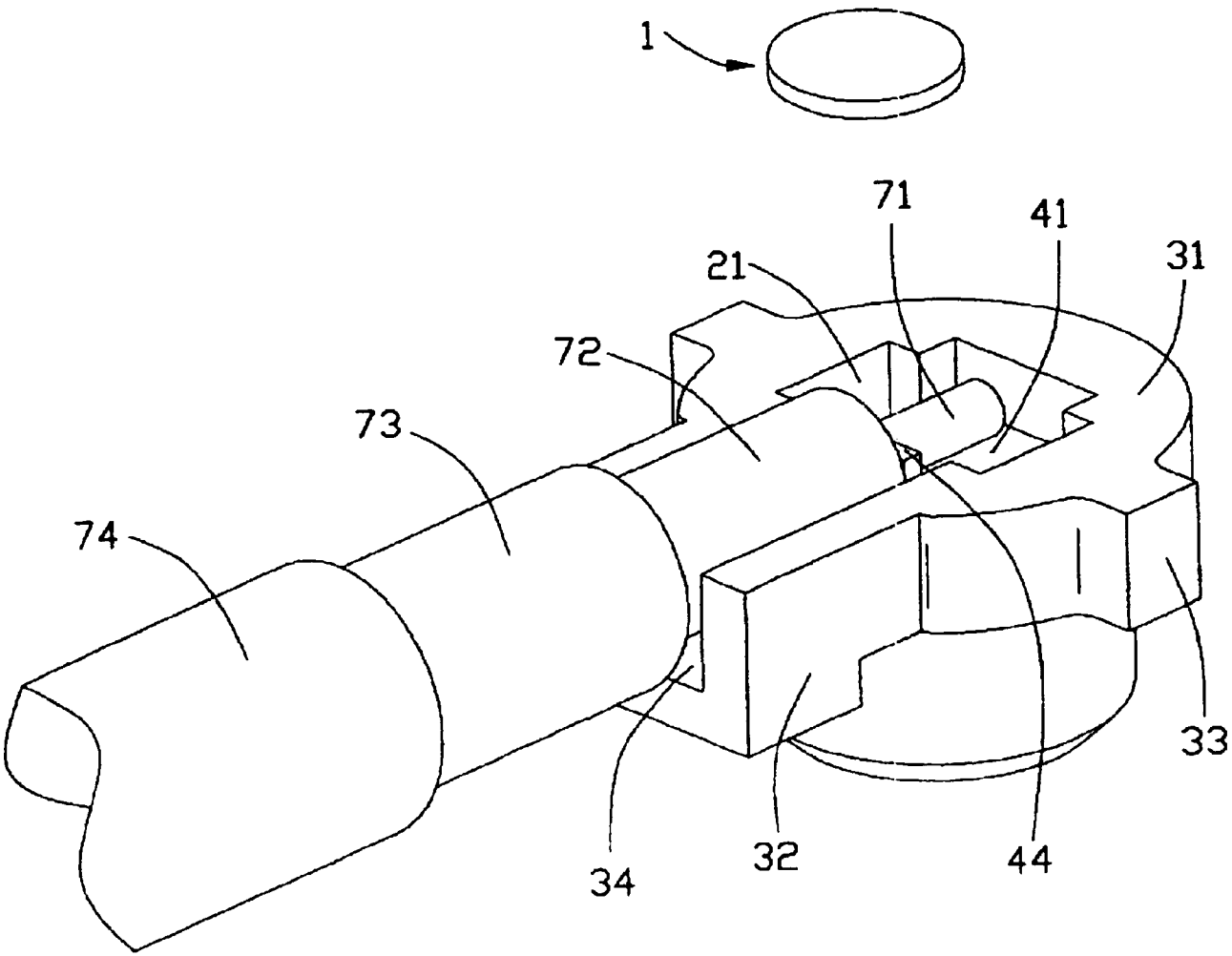
FIG. 3 is a partial assembled, upside-down view of FIG. 1.

Referring to the drawings and particularly to FIGS. 1 and 2, a cable end connector in accordance with the present invention comprises a dielectric housing 10, a terminal 40, a metal shell 50 enclosing the housing 10 and the terminal 40, a circular thin layer insulator 1 and a retainer 60 for securing an end portion of a coaxial cable 70 to the cable end connector.

The dielectric housing 10 comprises a base portion 30 and a tubular portion 20. The base portion 30 comprises a front circular portion 31 and a rear rectangular portion 32 extending rearwardly from the circular portion 31. A pair of engaging blocks 33 protrude laterally from the circular portion 31 to abut against the shell 50. A rearwardly exposed groove 34 is defined in a bottom of the base portion 30. The tubular portion 20 axially and upwardly projects from the front circular portion 31. A substantially rectangular passageway 21 is axially defined through the front circular portion 31 and the tubular portion 20, and communicates with the groove 34.

The terminal 40 includes a bottom portion 41 and a pair of mating wings 43. A pair of mating wings 43 extends upwardly from opposite lateral sides of the bottom portion 41 and projects toward each other for griping a mating of a complementary connector (not shown). A soldering tab 44 is bent downwardly from a rear side of the bottom portion 41. A recess 441 is defined through the soldering tab 44.

Figure 4:
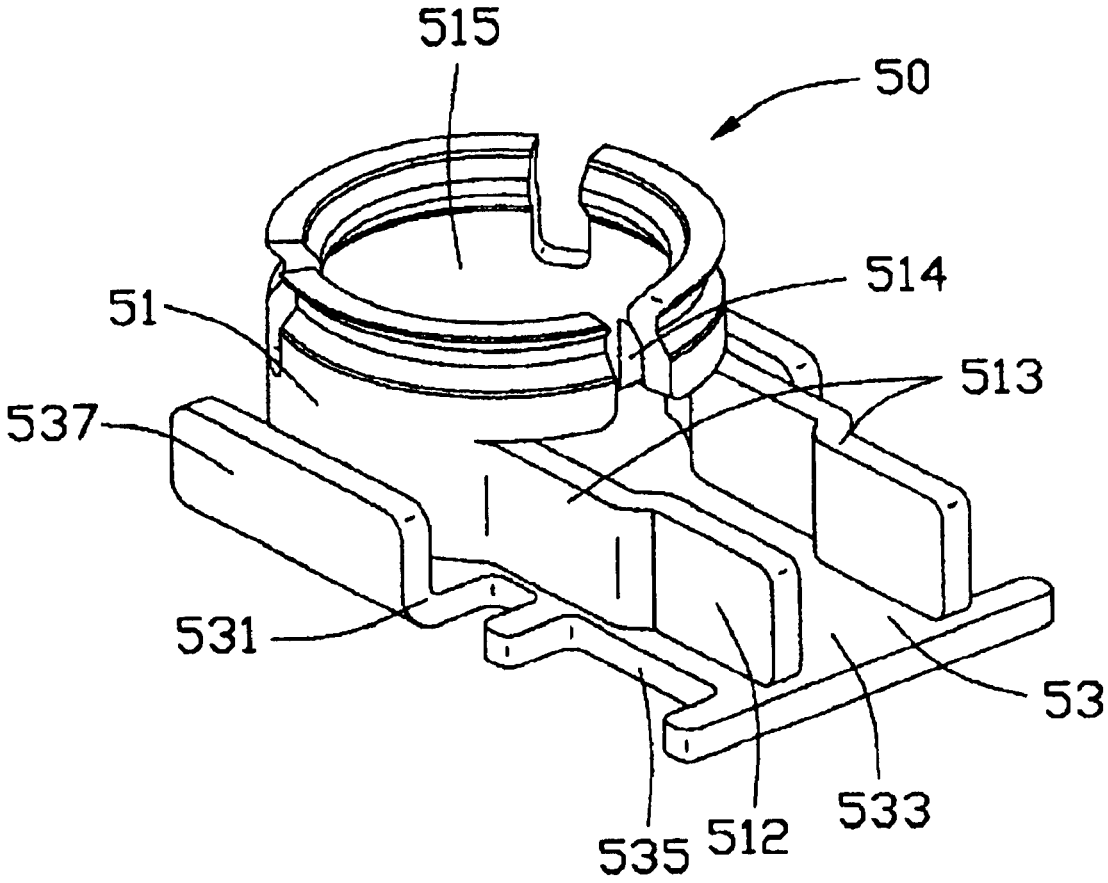
FIG. 4 is a perspective view of a metal shell of the cable end connector of FIG. 1.

Referring to FIG. 4, the shell 50 is unitarily formed of a metal sheet and comprises a substantially cylindrical trunk portion 51 and a substantially planar portion 53 connected to the trunk portion 51. It should be noted that, before bending, the planar portion 53 is oriented vertically below the trunk portion 51.

Figure 6:
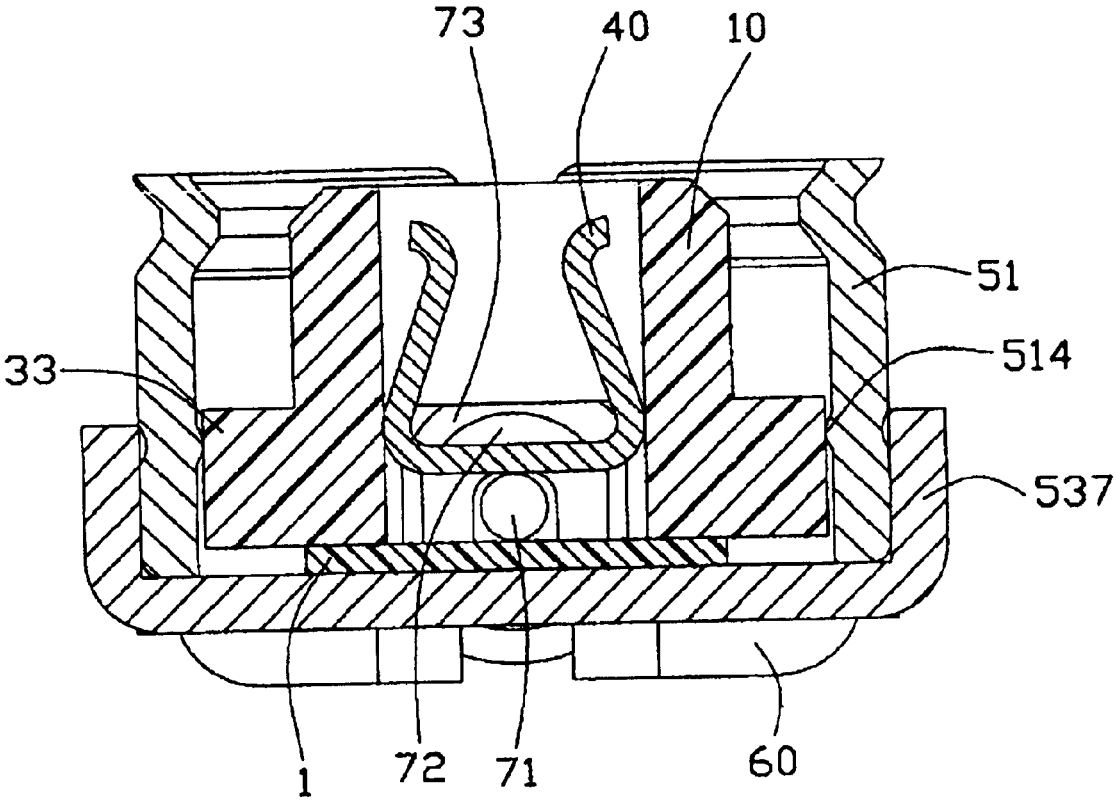
FIG. 6 is a cross-sectional view taken along a line 6—6 of FIG. 2.

The trunk portion 51 has a pair of arms 513 rearwardly extending from a lower portion thereof. Each arm 513 has an elongate distal end 512 protruding inwardly for accommodating the coaxial cable 70 therebetween. The trunk portion 51 defines a hollow portion 515 therethrough for receiving the tubular portion 20 of the housing 10. Preferably, a pair of holding protrusions 514 (shown in FIG. 6) are formed in a lower portion of the trunk portion 51 for interferentially cooperating with the pair of engaging blocks 33 of the housing 10.

The planar portion 53 has a front portion 531 and a rear portion 533 rearwardly extending from the front portion 531 beyond the distal ends 512 of the arms 513 for supporting the arms 513 and the rectangular portion 32 of the housing 10. The front portion 531 supports the trunk portion 51 of the shell 50 and the circular portion 31 of the housing 10. A pair of side walls 537 project from on opposite sides of the front portion 531 for interferentially engaging with the outer periphery of the trunk portion 51. A pair of cuts 535 are respectively defined in opposite sides of the rear portion 533.

In this preferred embodiment of the present invention, the circular thin layer insulator 1 is formed of a dielectric sheet. Alternatively, the circular thin layer insulator 1 can be formed of a dielectric material which is parasitically arranged on the front portion 531 of the metal shell 50.

Figure 5:
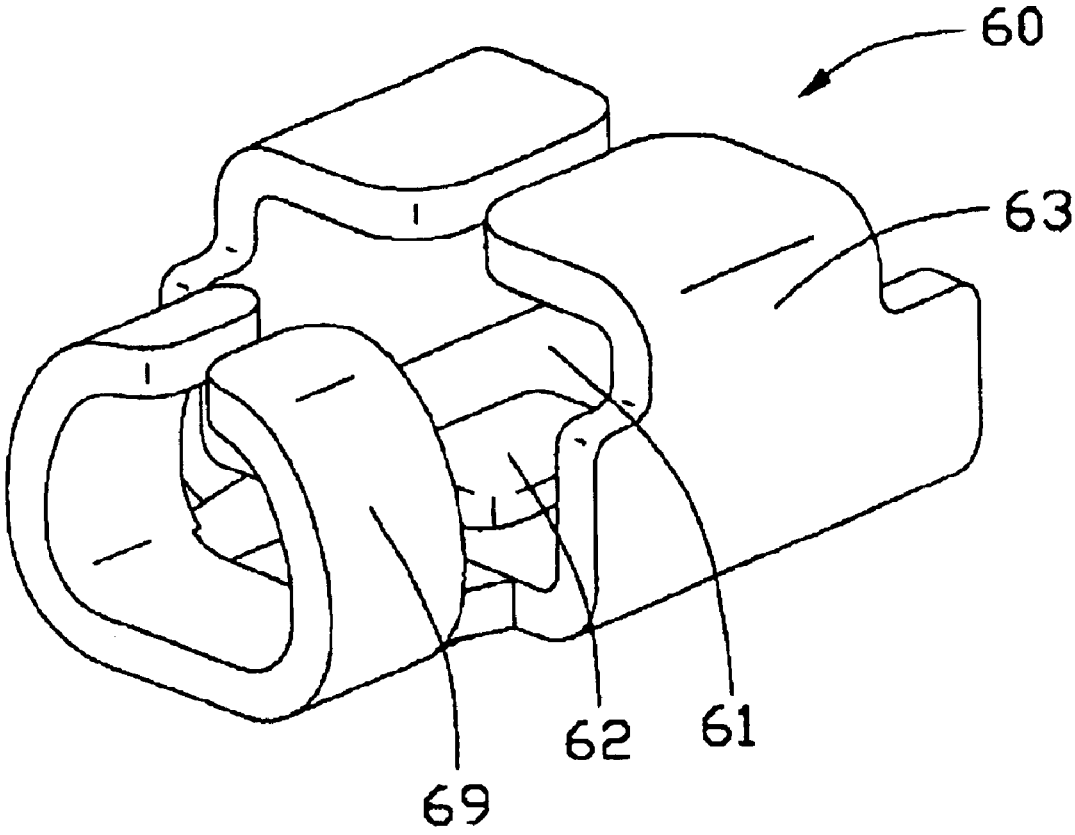
FIG. 5 is a perspective, upside-down view of a retainer of the cable end connector of FIG. 1.

With reference to FIGS. 1 and 5, the retainer 60 is conductive and comprises a planar top wall 61 and a strain relief 69 rearwardly extending from a rear edge of the top wall 61 for securely clamping the coaxial cable 70. A contacting portion 62 is depressed from the top wall 61 and protrudes inwardly. A pair of locking tabs 63 respectively depend downwardly from opposite lateral sides of the top wall 61 for engaging with the cut 535 of the shell 50.

Particularly referring to FIG. 1, the coaxial cable 70 includes an inner conductor 71, a conductive braiding layer 73, an inner insulator 72 separating the inner conductor 71 and the braiding layer 73, and an outer insulator 74 surrounding the braiding layer 73.

Referring to FIGS. 1–6, the cable end connector of the present invention is assembled as follows.

(1) The contacting wings 43 of the terminal 40 is inserted into the passageway 21 through the groove 34 of the housing 10, abutting against corresponding inner walls (not labeled) of the passageway 21. The soldering tab 44 of the terminal 40 is retained in the groove 34.

(2) The inner insulator 72 of the coaxial cable 70 is inserted in the groove 34, and the inner conductor 71 extends forwardly through the recess 441 of the terminal 40 and is soldered to the soldering tab 44 and a lower surface of the bottom portion 41 of the terminal 40.

(3) The trunk portion 51 of the shell 50 encircles the tubular portion 20 of the housing 10 with the holding protrusions 514 abutting against the engaging blocks 33. The arms 513 accommodate the rectangular portion 32 of the housing 10 therebetween.

(4) The circular thin layer insulator 1 is positioned between the front circular portion 31 of the housing 10 and the planar portion 53 of the shell 50.

(4) The planar portion 53 of the shell 50, which is originally oriented vertically downward, is now bent toward the trunk portion 51 until the planar portion 53 securely presses the circular thin layer insulator 1 to cover a lower opening of the passageway 2 defined in the bottom of the housing 10.

(5) The locking tabs 63 of the retainer 60 engage with the corresponding cuts 535 and abut against the bottom of the planar portion 53, thereby fixedly retaining the arms 513 to an upper face of the planar portion 53. The braiding layer 73 of the coaxial cable 70 is therefore surrounded by both the arms 513 and the top wall 61 of the retainer 60. The shell 50 electrically connects with the braiding layer 73 by the arms 513 engaging with the braiding layer 73 and the retainer 60 electrically connects with the braiding layer 73 by the contacting portion 62 engaging with the braiding layer 73, which makes the braiding layer 73 reliably grounded. The outer insulator 74 of the coaxial cable 70 is firmly retained in the strain relief 69 of the retainer 60.

By such a design, the terminal 40 and the inner conductor 71 are insulated from the shell 50 by the covering of the circular thin layer insulator 1. When the terminal 40 suffers from a large mating force of the header, the circular thin layer insulator 1 prevents the terminal 40 and the inner conductor 71 of the coaxial cable 70 from touching the planar portion 53 of the shell 50, thereby achieving a good insulation function. In addition, the thickness of the circular thin layer insulator 1 is also provided for matching the impedance of the cable end connector for a high frequency application. Furthermore, with the circular thin layer insulator 1, the cable end connector has a low profile.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector adapted to be assembled to an end of a coaxial cable, comprising:

an insulative housing defining a passageway therethrough;

a terminal received in the passageway of said housing;

a metal shell enclosing the housing;

a separate insulating piece disposed between the housing and the metal shell for insulating the terminal from the shell; and a retainer retaining the metal shell and the housing to the end of the coaxial cable, the retainer comprising a top wall having in wardly extended contact portion for electrically correcting with a braid layer of the coaxial cable and a pair of locking tabs for wrapping a braiding layer of the coaxial cable and the metal shell;

wherein the separate insulating piece comprises a thin layer insulator;

wherein the housing comprises a base portion, the base portion comprising a front portion having a pair of engaging blocks, the passageway being defined through the front portion, the base portion defining a groove communicating with the passageway;

wherein the metal shell comprises a planar portion and a trunk portion which is formed in a lower portion thereof and having a pair of holding protrusions for interferential cooperating with the pair of engaging blocks, the planar portion covering the base portion of the housing, the trunk portion enclosing the front portion of the base portion, wherein the retainer is positioned opposite with the planar portion of the metal shell; and wherein the thin layer insulator is positioned between the front portion of the housing and the planar portion of the metal shell.

2. The cable end connector as claimed in claim 1, wherein the thin layer insulator covers a lower opening of the passageway.

3. The cable end connector as claimed in claim 1, wherein the groove is adapted to receive an inner conductor of the coaxial cable, the terminal is adapted to electrically connect with the inner conductor.

4. The cable end connector as claimed in claim 3, wherein the thin layer insulator covers at least a part of the groove.

5. The cable end connector as claimed in claim 3, wherein the retainer comprises a substantially C-shaped strain relief extending from the top wall for wrapping an outer insulator of the coaxial cable.

6. A cable end connector assembly comprising:

a dielectric housing defining a base portion including front an rear portions thereof with a tubular portion upwardly extending from the front portion, the front portion having paid of engaging block;

a terminal received in the front portion of the base portion and extending upwardly into the tubular portion;

a metal shell assembling including a planar portion enclosing the base portion, and a cylindrical trunk portion being formed in a lower portion thereof and having a pair of holding portions for interferential cooperating with the pair of engaging blocks, and enclosing the tubular portion a portion of the planar portion of the shell located right under the front portion of the base portion;

a coaxial cable including concentric inner conductor, inner insulator, conductive braiding layer and outer insulator circumferentially arranged with one another and extending from the rear portion of the base portion into the front portion thereof; and a discrete insulative spacer being located between the front portion of the base portion and said portion of the shell to mechanically and electrical y isolate the terminal and the associated inner conductor from said portion of the sell; wherein the terminal defines a bottom portion with a pair of mating wings respectively extending upwardly from two opposite lateral sides thereof and a tab downwardly extending from an edge located between said two lateral sides under a condition that the tab defines a recess receivably engaged with a front end of the inner conductor; wherein the insulative spacer is located outside of the housing and under the front end of the inner conductor of the terminal, and is tightly sandwiched between the housing the portion while, is radially spatially within the portion;

a retainer retaining the metal shell and the housing to the end of the coaxial cable, the retainer comprising a top wall with an inwardly extended containing portion for electrically connecting with the braiding layer of the coaxial cable, wherein the retainer is positioned opposite with the planar portion of the metal shell.

* * * * *